US009278801B2

(12) United States Patent
Gruder

(10) Patent No.: US 9,278,801 B2
(45) Date of Patent: Mar. 8, 2016

(54) BEVERAGE MIXING CARTRIDGE AND METHOD OF USING SAME

(71) Applicant: Robert Gruder, Charlotte, NC (US)

(72) Inventor: Robert Gruder, Charlotte, NC (US)

( * ) Notice: Subject to any disclaimer, the term of this patent is extended or adjusted under 35 U.S.C. 154(b) by 0 days.

(21) Appl. No.: 14/513,492

(22) Filed: Oct. 14, 2014

(65) Prior Publication Data

US 2015/0166258 A1 Jun. 18, 2015

Related U.S. Application Data

(60) Provisional application No. 61/917,577, filed on Dec. 18, 2013.

(51) Int. Cl.
*B65D 85/804* (2006.01)

(52) U.S. Cl.
CPC ..... *B65D 85/8043* (2013.01)

(58) Field of Classification Search
CPC ..... B65D 85/8046; B65D 85/8043; B65D 85/804
USPC ..... 426/77; 222/145.5, 145.6; 141/11, 69, 141/105, 106
See application file for complete search history.

(56) References Cited

U.S. PATENT DOCUMENTS

2007/0144355 A1* 6/2007 Denisart et al. ..... 99/275
2010/0203198 A1* 8/2010 Yoakim et al. ..... 426/80

OTHER PUBLICATIONS

"Nestlé launches BabyNes, the first comprehensive nutrition system for babies, in Switzerland", www.nestle.com.

* cited by examiner

*Primary Examiner* — Erik Kashnikow
*Assistant Examiner* — Ericson M Lachica
(74) *Attorney, Agent, or Firm* — Ashley Law Firm P.C.; Stephen S. Ashley, Jr.

(57) ABSTRACT

An apparatus for preparing a beverage includes a housing, and one or more swirl-inducing sections positioned within the housing. A beverage medium, such as instant infant formula powder or a flavored drink mix, can be contained within the housing. Each swirl-inducing section can include a substantially arcuate channel having an entrance opening and an exit opening. When a liquid, such as water, is introduced into the housing, it can flow into the arcuate channel, which produces a swirling movement of the liquid that helps to thoroughly break up and evenly disperse the beverage medium throughout the liquid to produce a thoroughly mixed beverage that is ready for consumption.

16 Claims, 22 Drawing Sheets

BEVERAGE MIXING CARTRIDGE AND METHOD OF USING SAME

CROSS-REFERENCE TO RELATED APPLICATIONS

This application claims priority to U.S. Provisional Patent Application No. 61/917,577, filed Dec. 18, 2013, which is incorporated herein by reference.

TECHNICAL FIELD AND BACKGROUND OF THE INVENTION

The present invention relates to an apparatus for facilitating the mixing of a liquid and a substance, such as solid particles. One embodiment of the invention comprises a beverage mixing cartridge that facilitates the mixing of a solid beverage medium, such as infant formula powder, in a liquid such as water or milk.

Cartridges adapted for brewing a single serving of coffee are known in the art. Such cartridges are typically comprised of a plastic housing that contains enough ground coffee to brew about one serving of coffee. The cartridge is typically positioned in a brewing apparatus that pierces the cartridge and injects an amount of hot water into the cartridge to produce a single serving of coffee. Such systems may be adequate to produce a satisfactory serving of coffee as the extremely hot water produced by the coffee brewing machines is conducive to mixing with the ground coffee. Also, coffee steeps, which makes it easier to produce a substantially homogenous beverage mixture. However, many beverages other than coffee, such as infant formula and soft drinks, are not steeped and are served at room temperature or colder. As the temperature of water or other liquid decreases, so does the solubility of most solids. As such, it can be particularly difficult to thoroughly disperse solid particles within a single serve beverage cartridge using water that is room temperature or colder.

SUMMARY OF THE INVENTION

Therefore, one object of the present invention is to provide an apparatus that can facilitate the dispersion and mixing of solid particles within a liquid. Another object of the present invention is to provide a single serve beverage cartridge that can thoroughly mix a solid beverage medium, such as infant formula powder, and a liquid such as water or milk at approximately room temperature. These and other objects of the invention can be achieved in various embodiments of the invention described below.

An apparatus for mixing a substance and a liquid according to a preferred embodiment of the invention comprises a housing, and at least one swirl-inducing section positioned within the housing. The swirl-inducing section receives liquid introduced into the housing, and produces a substantially swirling movement of the liquid as the liquid exits the swirl-inducing section.

According to another embodiment of the invention, the substance comprises a beverage medium contained within the housing.

According to another embodiment of the invention, the beverage medium is comprised of solid instant infant formula particles.

According to another embodiment of the invention, the swirl-inducing section comprises a first channel section comprising a first substantially arcuate channel, having first and second opposed ends. The first end defines a receptacle for receiving the liquid, and the second end defines a first channel opening for exiting the liquid. Movement of the liquid through the first arcuate channel produces swirling movement of the liquid as the liquid exits the first channel opening.

According to another embodiment of the invention, the receptacle is formed proximate a center of the first channel section and is substantially circular.

According to another embodiment of the invention, a top cover plate can be positioned over the first channel section. The cover plate has an opening positioned above the receptacle to direct liquid into the receptacle.

According to another embodiment of the invention, the first channel section comprises a substantially circular plate, the housing is substantially conical, and the top cover plate is substantially circular.

According to another embodiment of the invention, the second end of the first substantially arcuate channel is proximate an outer edge of the first channel section.

According to another embodiment of the invention, the cartridge includes a second channel section positioned within the housing below the first channel section. The second channel section comprises a second substantially arcuate channel having a an inlet end for receiving the liquid and an opposed outlet end defining a second channel opening for exiting the liquid. Movement of the liquid through the second arcuate channel produces swirling movement of the liquid as the liquid exits the opening.

According to another embodiment of the invention, the second channel includes a base that declines from the first end of the second channel to the second end of the second channel.

According to another embodiment of the invention, a flow distributor section can be positioned over the second channel section, and has an opening positioned above the inlet end of the second channel to direct liquid into the second channel.

According to another embodiment of the invention, an elongate support member extends upwardly from a center of the second channel section and supports the first channel section.

According to another embodiment of the invention, the elongate support member is attached to a bottom surface of the first channel section.

According to another embodiment of the invention, a second channel section cover plate can be positioned on an upper surface of the second channel section. The second channel cover plate has a center opening for receiving the elongate support member there through, and a directional opening positioned over the first end of the second channel to direct liquid into the second channel.

According to another embodiment of the invention, a first channel section cover plate can be positioned on an upper surface of the first channel section. The first channel section cover plate has a center opening positioned over the receptacle of the first channel, such that liquid is directed into the receptacle.

A beverage mixing cartridge according to a preferred embodiment of the invention comprises a housing having a top wall, a base wall and at least one side wall connected to the top wall and the base wall. A beverage medium and at least one swirl-inducing section are contained within the housing. The swirl-inducing section receives liquid introduced into the housing, and produces a substantially swirling movement of the liquid as the liquid exits the swirl-inducing section.

According to another embodiment of the invention, the beverage mixing cartridge comprises first and second channel sections. The first channel section is positioned within the housing and comprises a first substantially arcuate channel. The first substantially arcuate channel having first and second opposed ends, the first end defining a receptacle for receiving a liquid, and the second end defining a first channel opening for exiting the liquid. Movement of the liquid through the first arcuate channel produces swirling movement of the liquid as the liquid exits the first channel opening. The second channel section is positioned within the housing below the first channel section, and comprises a second substantially arcuate channel having a first end for receiving the liquid and a second opposed end defining a second channel opening for exiting the liquid. Movement of the liquid through the second arcuate channel causes further swirling movement of the liquid as the liquid exits the second channel opening, such that the beverage medium is thoroughly mixed with the liquid to produce a beverage.

According to another embodiment of the invention, a first flow distributor plate is positioned over the first channel section, the first flow distributor plate having a center opening positioned over the receptacle of the first channel, so that liquid is directed into the receptacle of the first channel section. An elongate support member extends upwardly from a center of the second channel section and supports the first channel section. A second flow distributor plate is positioned below the first channel section and above the second channel section. The second flow distributor plate has a center opening for receiving the elongate support member there through, and a directional opening positioned above the first end of the second channel, such that liquid that has exited the first channel is directed into the second channel.

According to another embodiment of the invention, the first channel section can be attached to the top wall of the housing, and the top wall can be pivotally attached to the side wall of the housing.

A method of preparing a beverage according to another embodiment of the invention comprises providing a beverage mixing cartridge comprising a housing, a beverage medium contained in the housing, and at least one channel section positioned within the housing comprising a substantially arcuate channel having first and second opposed ends. The first end defines an inlet for receiving a liquid, and the second end defines an outlet for exiting the liquid. A liquid, such as water or milk, is introduced into the substantially arcuate channel. The liquid moves through the substantially arcuate channel, which results in a substantially swirling movement of the liquid as the liquid exits through the outlet, such that the beverage medium is mixed with the liquid.

According to another embodiment of the invention, the top wall of the housing is pierced, and liquid is introduced there through.

According to another embodiment of the invention, the base wall of the housing is pierced, and prepared beverage exits there through.

Another embodiment of the invention comprises a beverage cartridge that allows for easier and cleaner mixing of beverage mediums with liquids. The cartridge includes a container, a foil lid covering an opening of the container, and a beverage medium just below the lid ready for mixing. The beverage medium can be in the form of powders, crystals, granules, or concentrates. When liquid is introduced to the beverage medium, the combined liquid enters a mixing chamber in which the beverage medium is thoroughly dissolved into the liquid. After the beverage is dispersed and mixed, the used container can be disposed of, thus avoiding the mess of mixing a beverage and liquid outside a sealed container.

According to another embodiment of the invention, the cartridge includes beverage medium in a first chamber which then flows to a second mixing chamber. A flow distributor can be located between the first portion of the lid and the beverage medium to help prevent backflow of the beverage medium located in the first chamber. This can help prevent fouling of a liquid inlet of a beverage machine that can occur if the beverage medium is permitted to contact the inlet.

According to another embodiment of the invention, the cartridge contains one or more beverage ingredients suitable for the formation of a blended beverage product. The beverage product can be a juice, iced tea, iced coffee, protein drink, energy drink, or infant formula. The beverage ingredients can be powdered, crystal, or liquid.

DESCRIPTION OF THE PREFERRED EMBODIMENTS OF THE INVENTION AND BEST MODE

Figure 1:
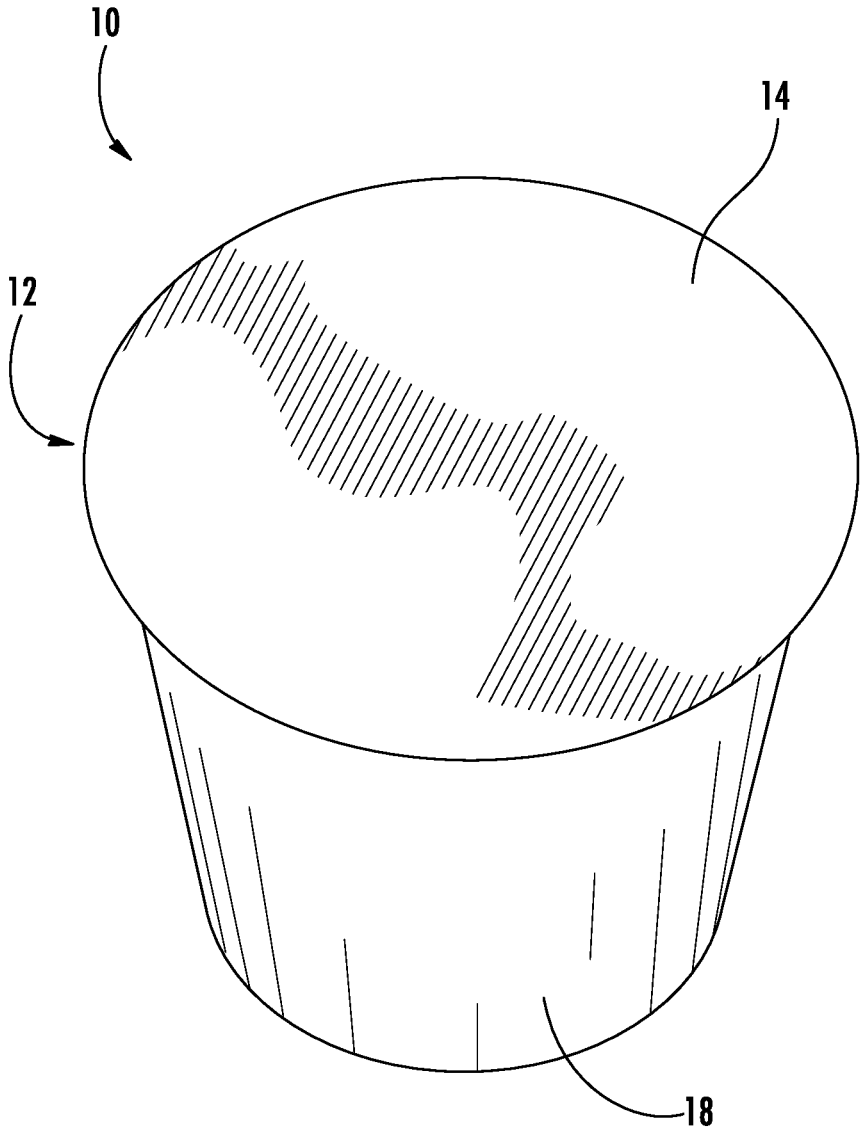
FIG. 1 is a perspective view of a beverage mixing cartridge according to a preferred embodiment of the invention.
Figure 2:
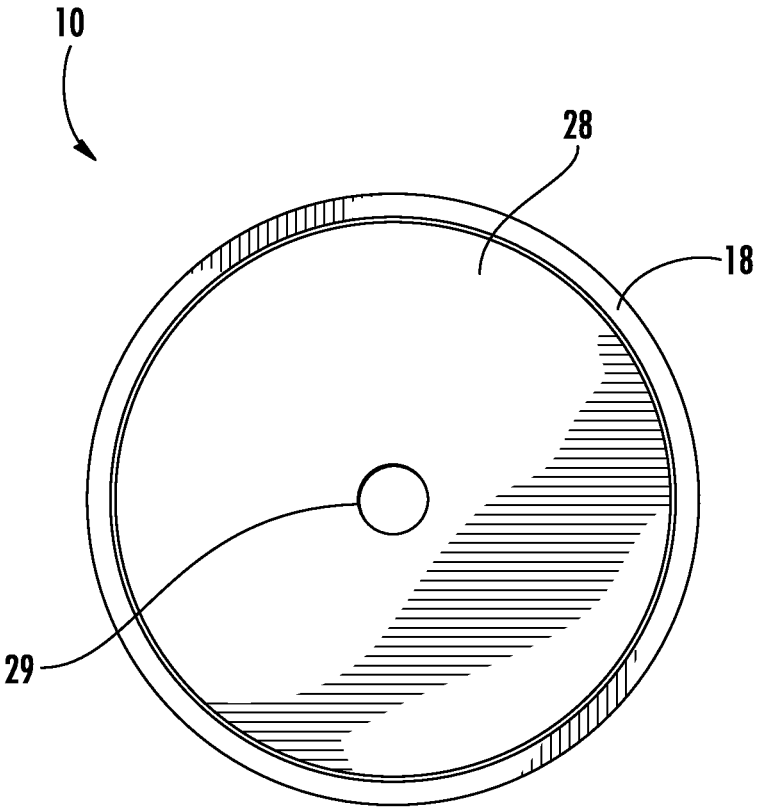
FIG. 2 is a top plan view of the cartridge of FIG. 1, with the top wall removed to show the top flow distributor section.
Figure 3:
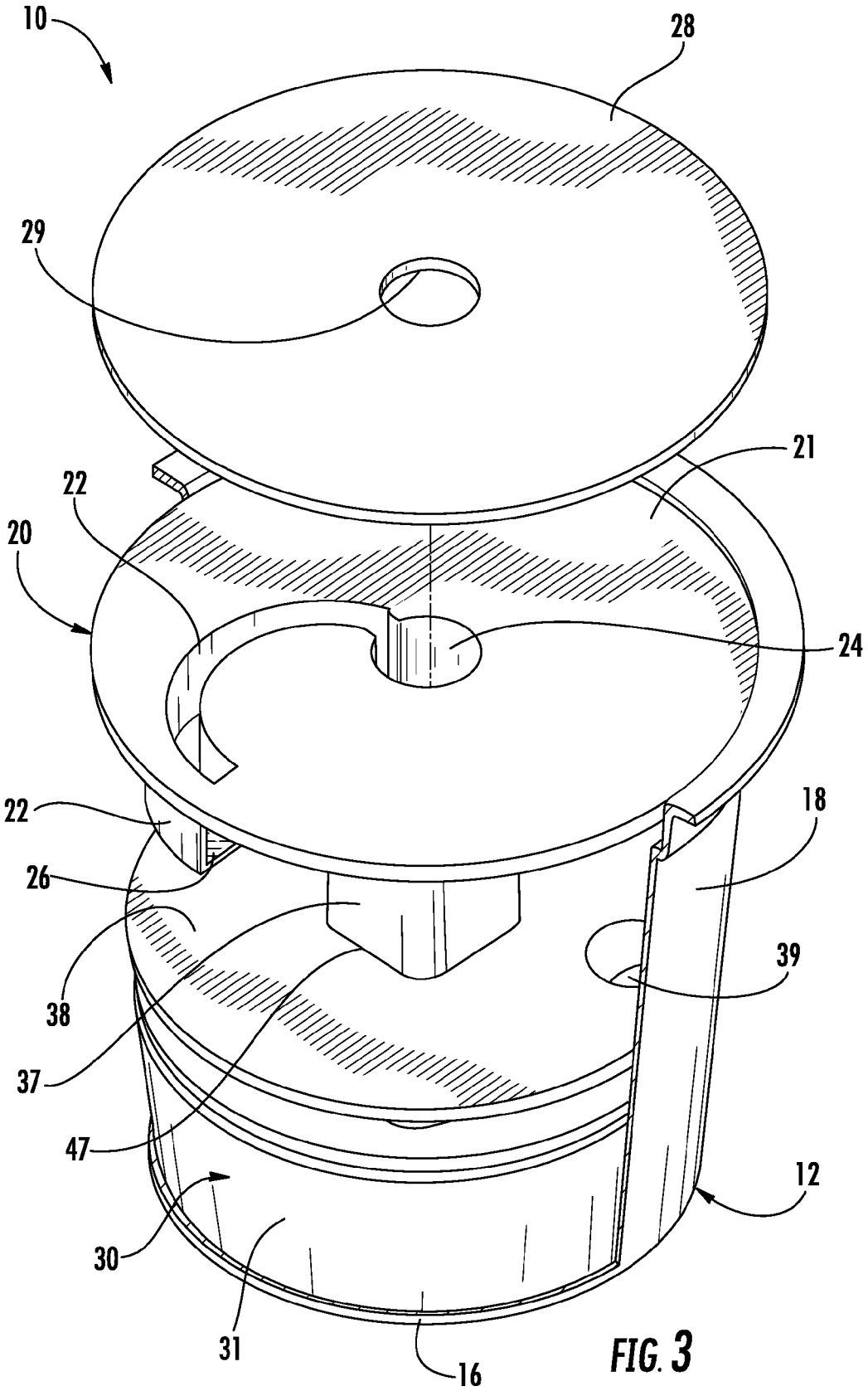
FIG. 3 is a partially exploded perspective view of the cartridge of FIG. 1.
Figure 4:
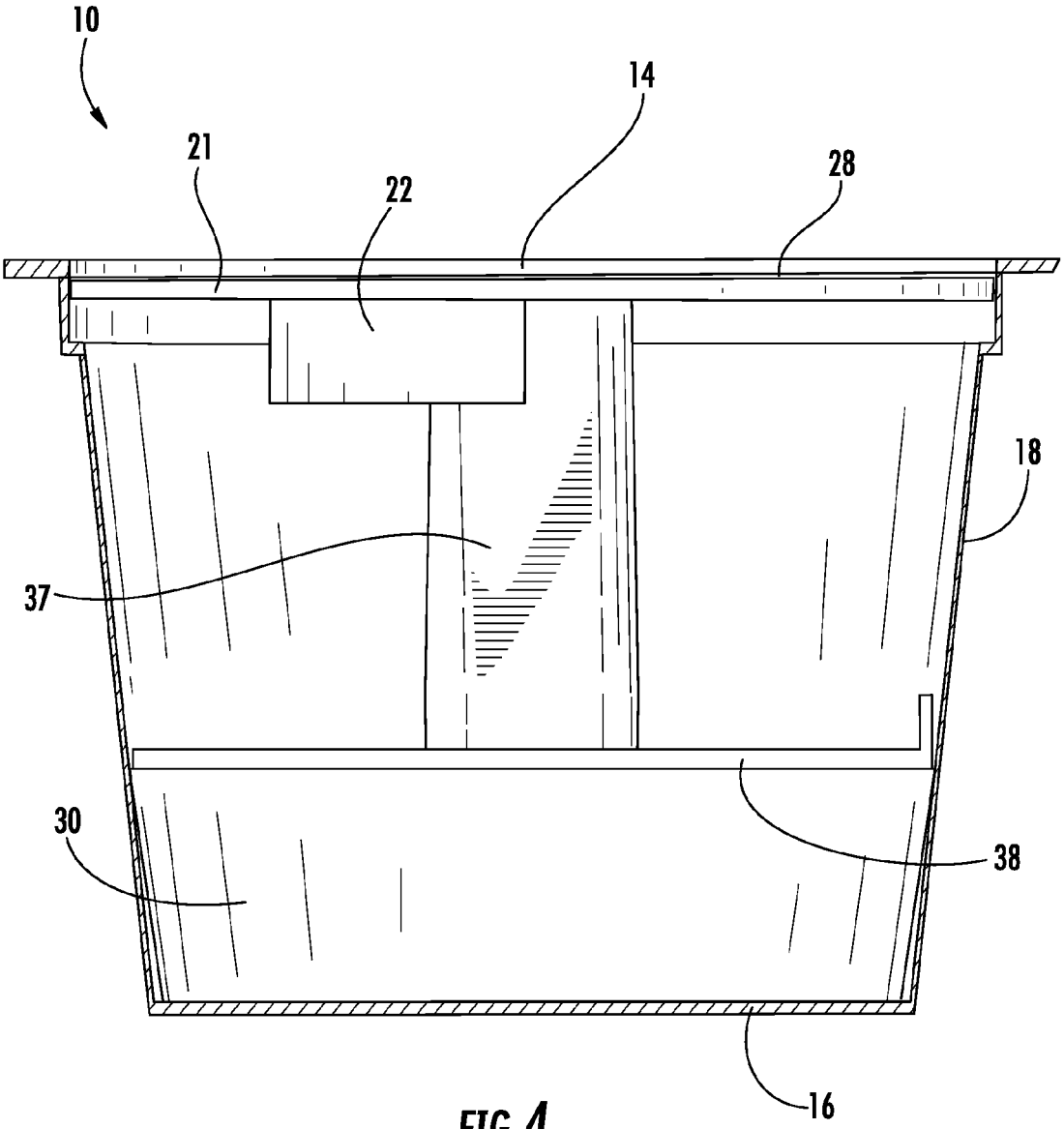
FIG. 4 is a cross sectional side view of the cartridge of FIG. 1.

A single serve beverage cartridge according to a preferred embodiment of the invention is illustrated in FIGS. 1-11, and shown generally at reference numeral 10. The beverage mixing cartridge 10 comprises a conical housing 12 having a top wall 14, a base wall 16 and a side wall 18 connecting the top wall 12 to the base wall 14, as shown in FIGS. 1, 3 and 4.

Figure 5:
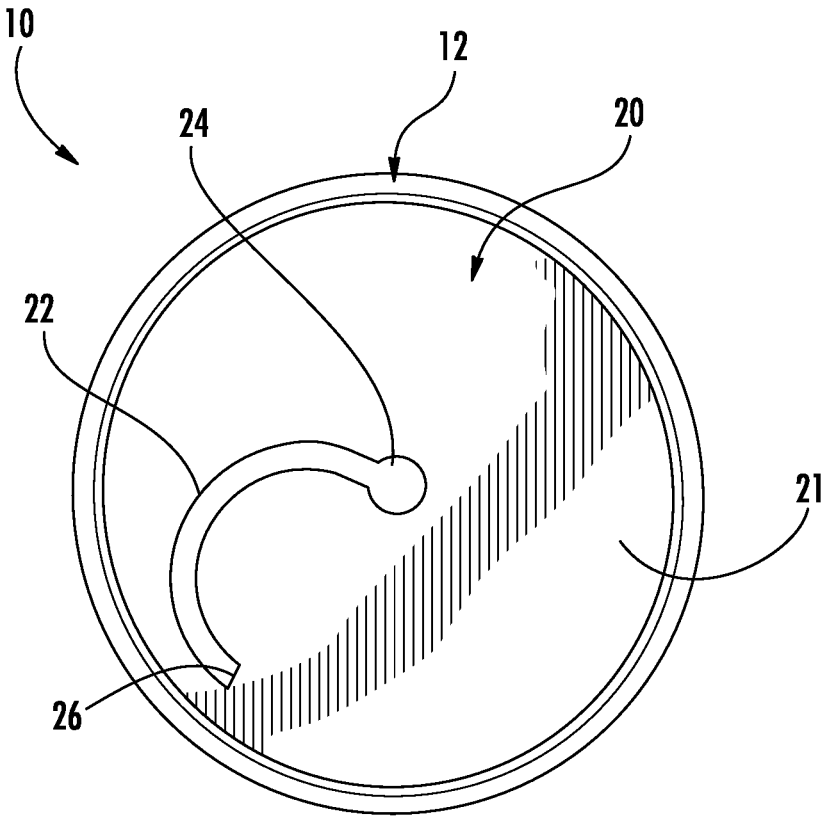
FIG. 5 is a top plan view of the upper channel section of the cartridge of FIG. 1.
Figure 6:
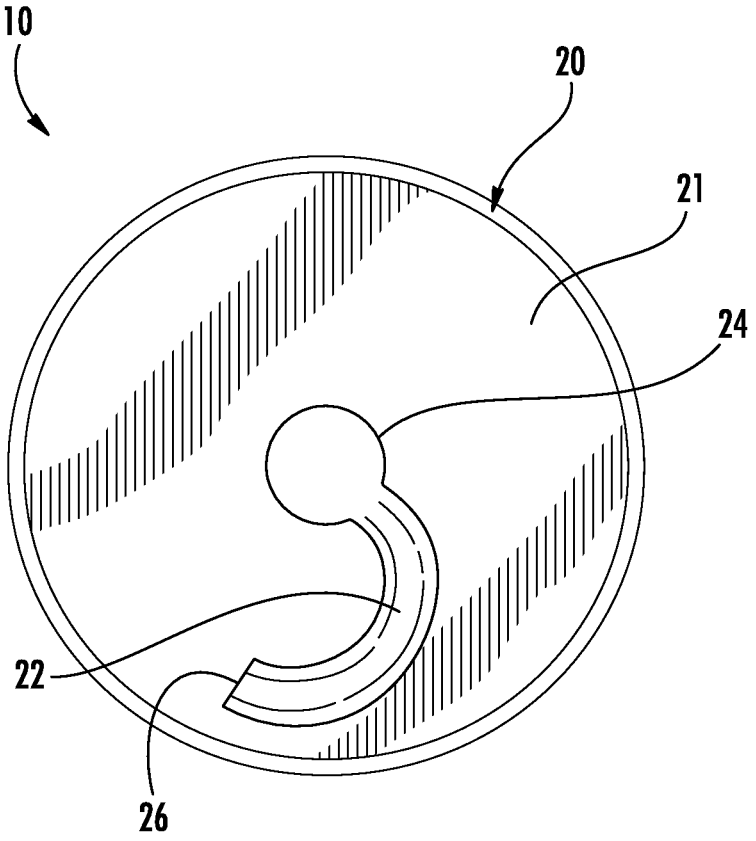
FIG. 6 is a bottom plan view of the upper channel section of the cartridge of FIG. 1.

The cartridge 10 includes two swirl-inducing sections that can receive liquid introduced into the cartridge 10, and cause the liquid to flow in a swirling or whirlpool-like motion. The first swirl-inducing section can be an upper channel section 20 positioned within the housing 12 proximate the top wall 12, as shown in FIGS. 3 and 4. The upper channel section 20 is comprised of a circular plate 21, and an arcuate channel 22 descending from the plate 21, as shown in FIGS. 3, 5 and 6. A substantially circular receptacle section 24 is formed at the center of the plate 21, and communicates with one end of the arcuate channel 22, as shown in FIGS. 3 and 5. The opposite end of the arcuate channel 22 defines an upper exit opening 26 that is positioned proximate the outer edge of the plate 21, as shown in FIG. 3. As such, the channel 22 extends in an arcuate manner from the center of the plate 21 to proximate the outer edge of the plate 21, as shown in FIGS. 3, 5 and 6. Alternatively, the channel section 20 can include a channel that is angled or L-shaped, or several straight channels in parallel that can produce a swirling motion.

The cartridge 10 can include an upper flow distributor section comprised of a top cover plate 28 positioned on top of the upper channel section 20, as shown in FIGS. 2 and 3. The top cover plate 28 can be positioned just below the top wall 14 of the housing 12, as shown in FIG. 4. A circular opening 29 is formed at the center of the top cover plate 28, as shown in FIGS. 2 and 3. As such, the top cover plate opening 29 is positioned directly above the receptacle 24 of the upper channel section 20, and the top cover plate opening 29 is in communication with the receptacle 24. Preferably, the top cover plate opening 29 has a slightly smaller diameter than the receptacle 24. The top cover plate 28 directs liquid into the upper arcuate channel 22, and minimizes back flow.

Figure 9:
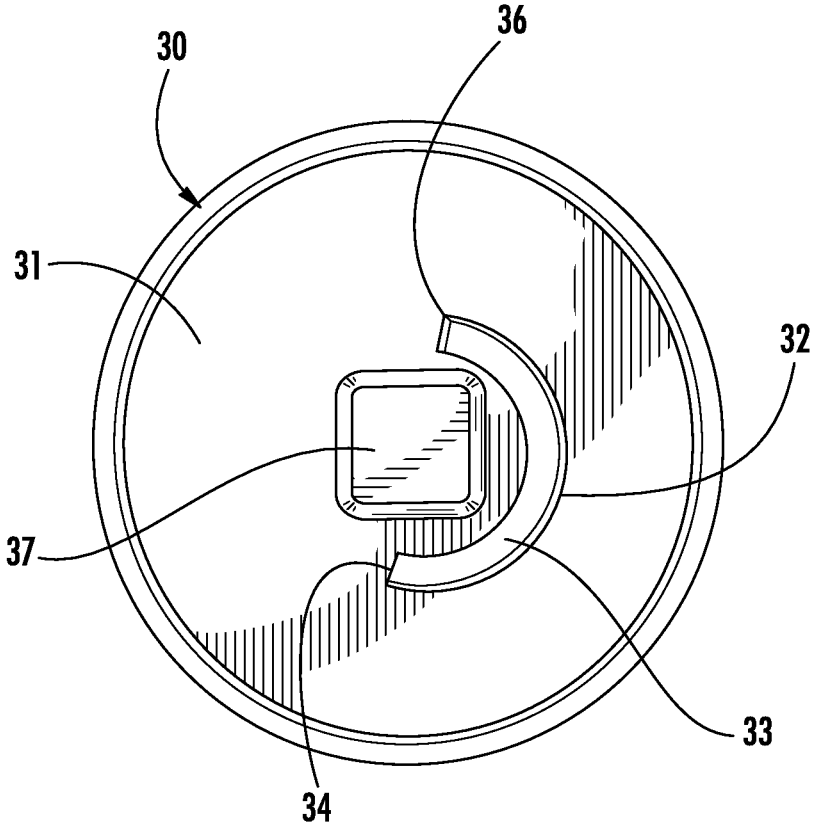
FIG. 9 is a top plan view of the lower channel section of the cartridge of FIG. 1.
Figure 10:
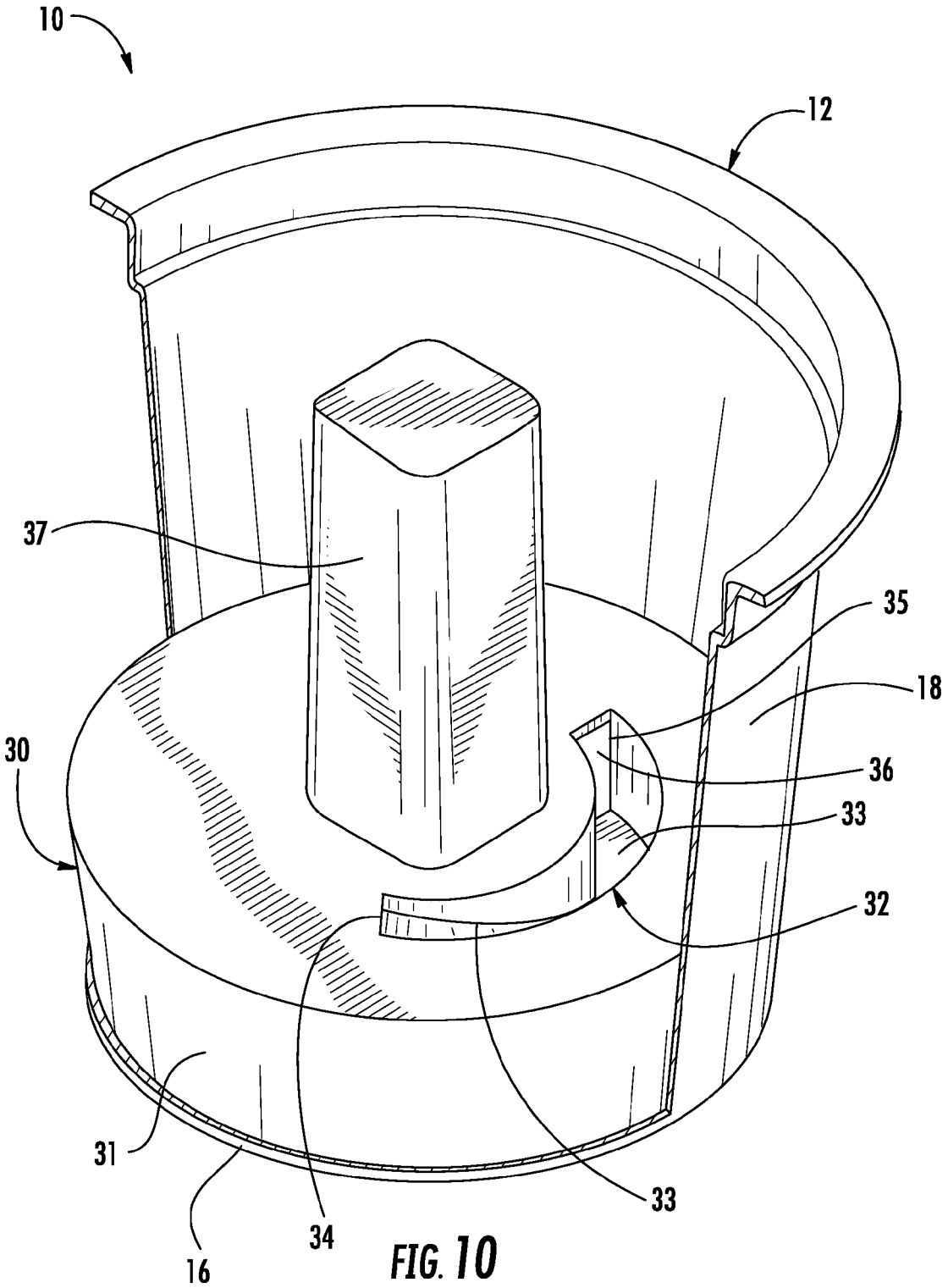
FIG. 10 is a partial cross sectional perspective view of the cartridge of FIG. 1, with the upper channel section and the lower flow distributor section removed.
Figure 11:
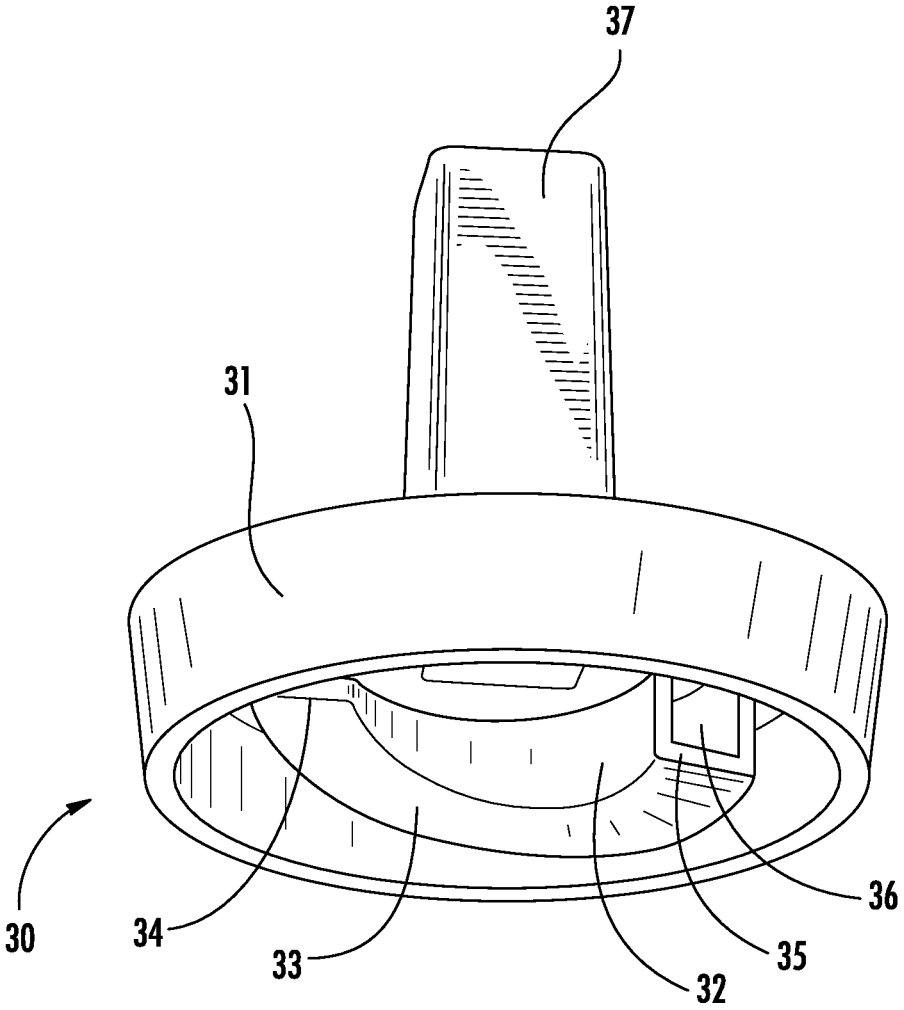
FIG. 11 is a perspective view of the lower channel section of the cartridge of FIG. 1.

A lower channel section 30 is positioned within the housing 12 below the upper channel section 20, as shown in FIGS. 3, 4 and 10. The lower channel section 30 is comprised of a substantially conical body 31, and an arcuate channel 32 descending from the upper surface of the body 31, as shown in FIGS. 9, 10 and 11. The bottom of the body 31 rests on the base wall 14 of the housing, as shown in FIG. 8.

The lower arcuate channel 32 has a first end 34 and a second opposed end 35 that defines a lower exit opening 36, as shown in FIGS. 10 and 11. The lower arcuate channel 32 includes a base 33 that declines from the first end 34 of the channel 32 to the second end 35 of the channel 32, as shown in FIGS. 10 and 11. An elongate support stem 37 extends upwardly from the center of the body 31, as shown in FIG. 10. The support stem 37 supports the upper channel section 20, as shown in FIG. 4. The top of the support stem 37 can be attached to the bottom surface of the receptacle 24 of the upper channel section 20 by sonic welding, adhesive or other suitable attachment means. Alternatively, the upper channel section 20 is unattached to the support stem 37, and the upper channel section 20 can be pressure fitted into the housing 12, such that the bottom of the receptacle 24 rests on the support stem 37. The support stem 37 can be a substantially rectangular column with rounded edges, as shown in FIG. 10. Alternatively, the support stem 37 can be substantially circular or other suitable shape. In another alternative embodiment, the support stem 37 can be replaced by a one or more shelves positioned on the interior surface of the side wall 18 of the housing 12 that support the upper channel section 20.

Figure 7:
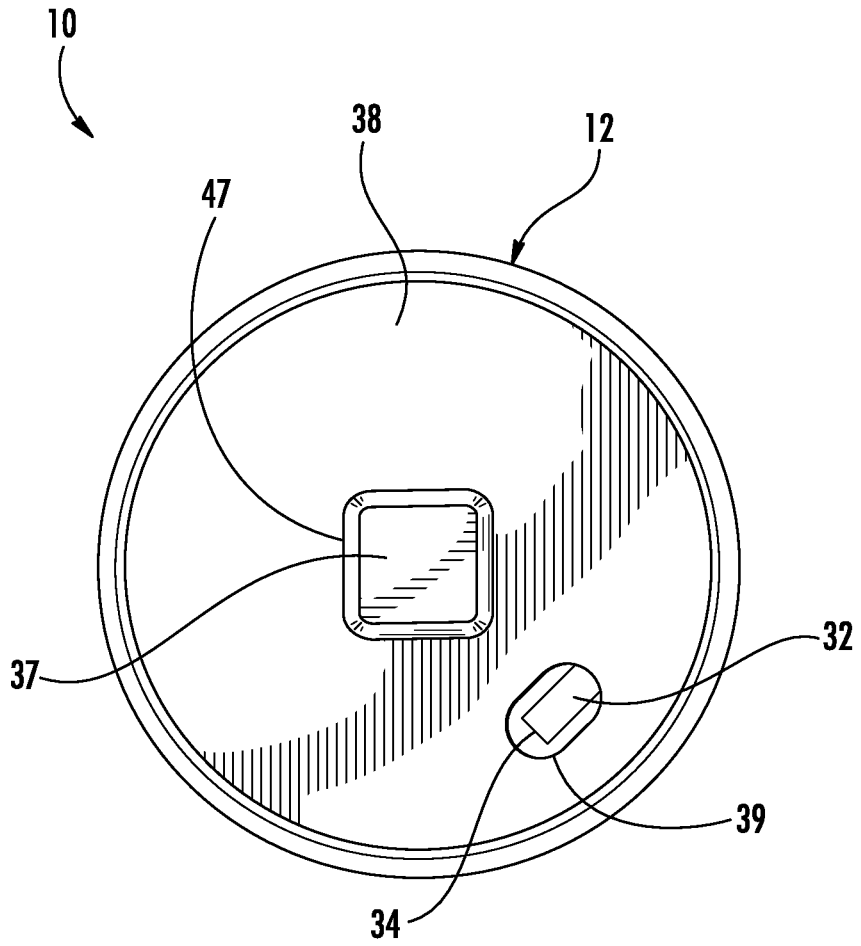
FIG. 7 is a plan view of the lower flow distributor section of the cartridge of FIG. 1.
Figure 8:
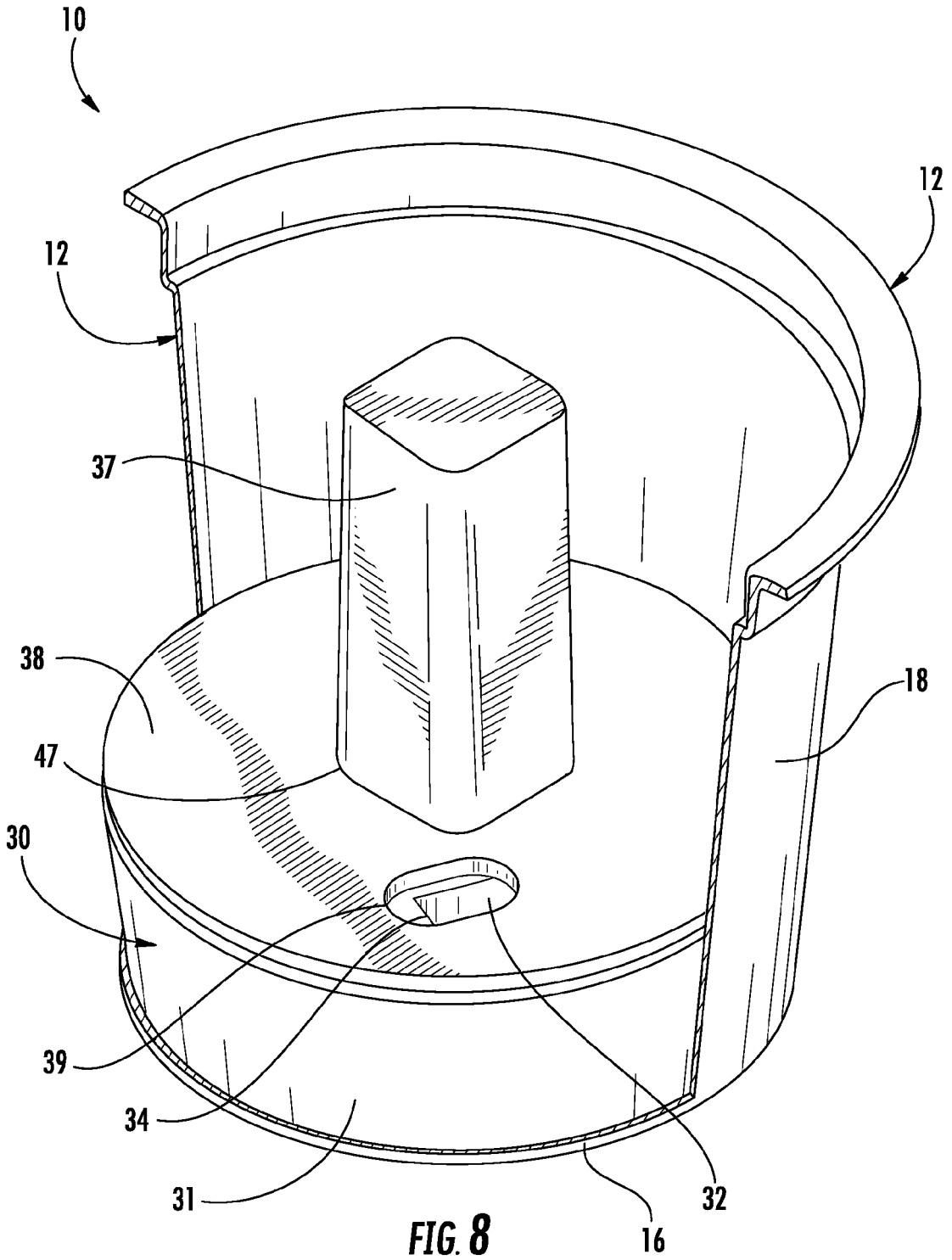
FIG. 8 is a partial cross sectional perspective view of the cartridge of FIG. 1, with the upper channel section removed.

The cartridge 10 can include a lower flow distributor section comprised of a lower cover plate 38 positioned on the lower channel section 30, as shown in FIGS. 7 and 8. The lower cover plate 38 has a substantially oval opening 39 that is positioned such that it is directly above the first end 34 of the lower channel 32, as shown in FIGS. 7 and 8. As such, the opening 39 is in communication with the first end 34 of the lower channel 32, and can direct liquid into the channel. The lower cover plate 38 also has a center opening 47 that is shaped, sized and positioned to receive the support stem 37 there through, as shown in FIGS. 7 and 8.

A substance, such as a beverage medium, can be contained within the housing 12 between the upper channel section 20 and the lower channel section 30. The beverage medium can be a soluble solid beverage medium can be instant infant formula in the form of powder, crystals and/or other solid particles that can be mixed with water or milk to produce liquid formula fit for drinking by infants. Alternatively, the beverage medium can be a flavored drink mix powder, such as the drink mix sold under the mark KOOL-AID by Kraft Foods, or instant tea or lemonade and the like. In yet another alternative embodiment, the beverage medium can be a liquid, such as the flavored syrups that can be mixed with carbonated water to produce soft drinks.

The housing 12 is made of an impermeable, but piercable material. The housing 12 can be made of a plastic such as polycarbonate, or other suitable material. Alternatively, the top wall 14 of the housing 12 can be made of a different material than the base 16 and side wall 18, such as a foil or polymer laminate. The inner components of the cartridge 10—the upper channel section 20, top cover plate 28, lower channel section 30, and lower cover plate 38—can be made of a plastic, such as acrylonitrile butadiene styrene, or other suitable material. The housing 12 can have the following preferred dimensions: side wall 18 height of about four to seven centimeters, base 16 diameter of about three to five centimeters, and a top wall diameter of about four to seven centimeters.

In a method of preparing a beverage according to a preferred embodiment of the invention, the cartridge 10 can be used to prepare a single serving of a particular beverage. The housing 12 contains a beverage medium, such as instant infant formula powder, in an amount sufficient to produce a single serving of the beverage when mixed with the appropriate amount of liquid, such as water or milk. The beverage medium can be positioned between the upper channel section 20 and the lower channel section cover plate 38.

The cartridge 10 can be placed in a beverage machine adapted for preparing a single serving of a beverage. An inlet needle from the beverage machine pierces the top wall 14 of the housing directly above the center opening 29 of the top cover plate 28, and the receptacle 24 of the upper channel section 20. An outlet needle from beverage machine can pierce the base 16 of the housing 12.

Water is expelled from the inlet needle of the beverage machine through the center opening 29 of the top cover plate 28, and into the receptacle 24 of the upper arcuate channel 22. The water can be room temperature or colder. The top cover plate 28 directs the water into the upper arcuate channel 22, and helps prevent the water and the beverage medium from back flowing and spilling out of the housing 12.

The water flows through the upper arcuate channel 22. The movement of the water through the upper arcuate channel 22 causes a swirling flow of the water as it exits the upper channel 22 through the exit opening 26. The swirling water flow helps agitate and thoroughly mix the beverage medium with the water. The swirling water and beverage medium mixture is directed into the lower arcuate channel 32 by the opening 39 in the lower channel section cover plate 38. Movement of the water through the lower arcuate channel 32 further facilitates swirling of the water flow to provide more agitation and mixing of the water and the beverage medium. The declined orientation of the lower arcuate channel 32 facilitates flow of the water and beverage medium mix through the lower exit opening 36. Upon exiting through the exit opening 36, the beverage medium has been thoroughly broken up and dispersed substantially uniformly throughout the water to produce a single serving of a clean flowing beverage that is ready for consumption at room temperature or colder. The prepared mixed beverage can exit the cartridge 10 through the outlet needle of the beverage machine that is pierced through the base 16 of the housing. After the beverage has been prepared, the cartridge 10 can be disposed of. The cartridge 10 can produce a single serving of infant formula at room temperature that is immediately ready for drinking.

While the cartridge 10 is described above in a method for producing beverages, it should be noted that the cartridge 10 is not limited to being used to prepare beverages. The cartridge 10 can be used to mix a variety of solid or liquid substances with a liquid to produce a substantially homogenous mixture or solution.

Figure 12:
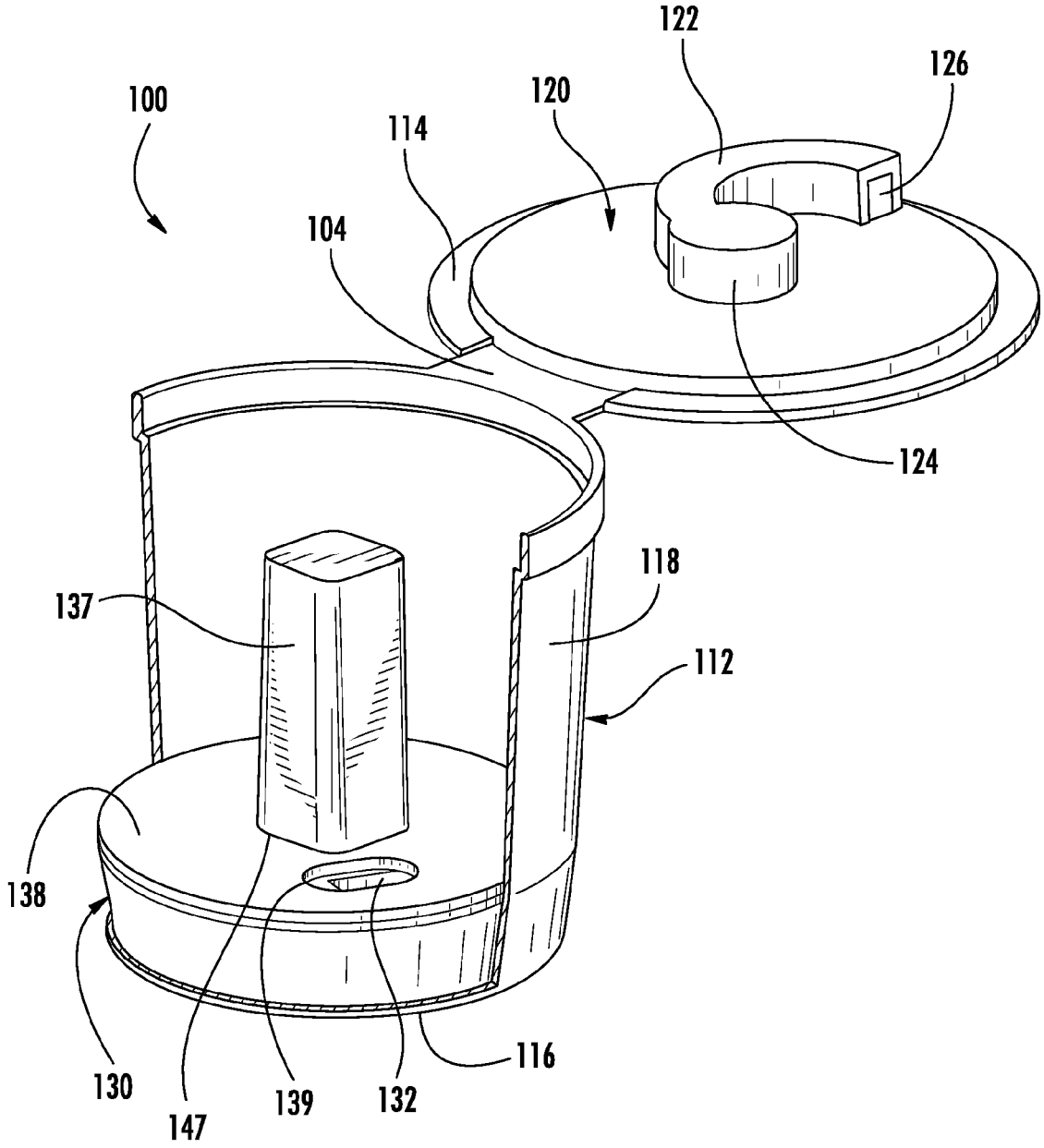
FIG. 12 is a partial cross sectional perspective view of a beverage mixing cartridge according to another preferred embodiment of the invention.

A single serve beverage mixing cartridge according to another preferred embodiment of the invention is illustrated in FIG. 12, and shown generally at reference numeral 100. The beverage mixing cartridge 100 comprises a conical housing 112 having a top wall 114, a base wall 116 and a side wall 118 connecting the top wall 112 to the base wall 116.

The cartridge 100 has a lower channel section 130 comprising a lower arcuate channel 132 that is identical in structure and function to the lower channel section 30 of the previously described cartridge 10. The cartridge 100 has a support stem 137 and a lower channel section cover plate 138 with an opening 139 that is identical in structure to the support stem 37 and lower channel section cover plate 138 of the previously described cartridge 10.

The cartridge 100 includes an upper channel section 120 comprised of a circular plate 121, and an arcuate channel 122 descending from the plate 121. A substantially circular receptacle section 124 is formed at the center of the plate 121, and communicates with one end of the arcuate channel 122, and the opposite end of the arcuate channel 122 defines an upper exit opening 126. As shown in FIG. 12, the upper channel section 120 is attached to the under surface of the top wall 114 of the housing 112, and the top wall 114 is pivotally connected to the housing side wall 118.

The housing 112 can be opened by moving the top wall 114 and upper channel section 120 to an open position, shown in FIG. 12, to a closed position, in which the top wall 114 sits atop the upper edge of the side wall 118. The housing 112 can be opened and re-closed multiple times so that the housing 112 can be refilled with a beverage medium after use and used again to prepare another beverage serving. As such, the cartridge 100 provides a reusable beverage mixing device.

The upper channel section 120 can be attached to the under surface of the top wall 114 by sonic welding, adhesive or other suitable attachment means. Alternatively, the top wall 114 and the upper channel section 120 can be integrally formed as a single piece, such as by injection molding. The top wall 114 can be pivotally attached to the side wall 118 by a hinge member 104.

A single serve beverage cartridge according to another preferred embodiment of the invention is illustrated in FIGS. 13-22, and shown generally at reference numeral 200. The beverage mixing cartridge 200 comprises a conical housing 212 that is identical to the housing 12 of the previously described cartridge 10, shown in FIG. 1. The housing 212 comprises a top wall 212, a base wall 216 and a side wall 218 connecting the top wall 212 to the base wall 14, as shown in FIGS. 1, 3 and 4.

Figure 13:
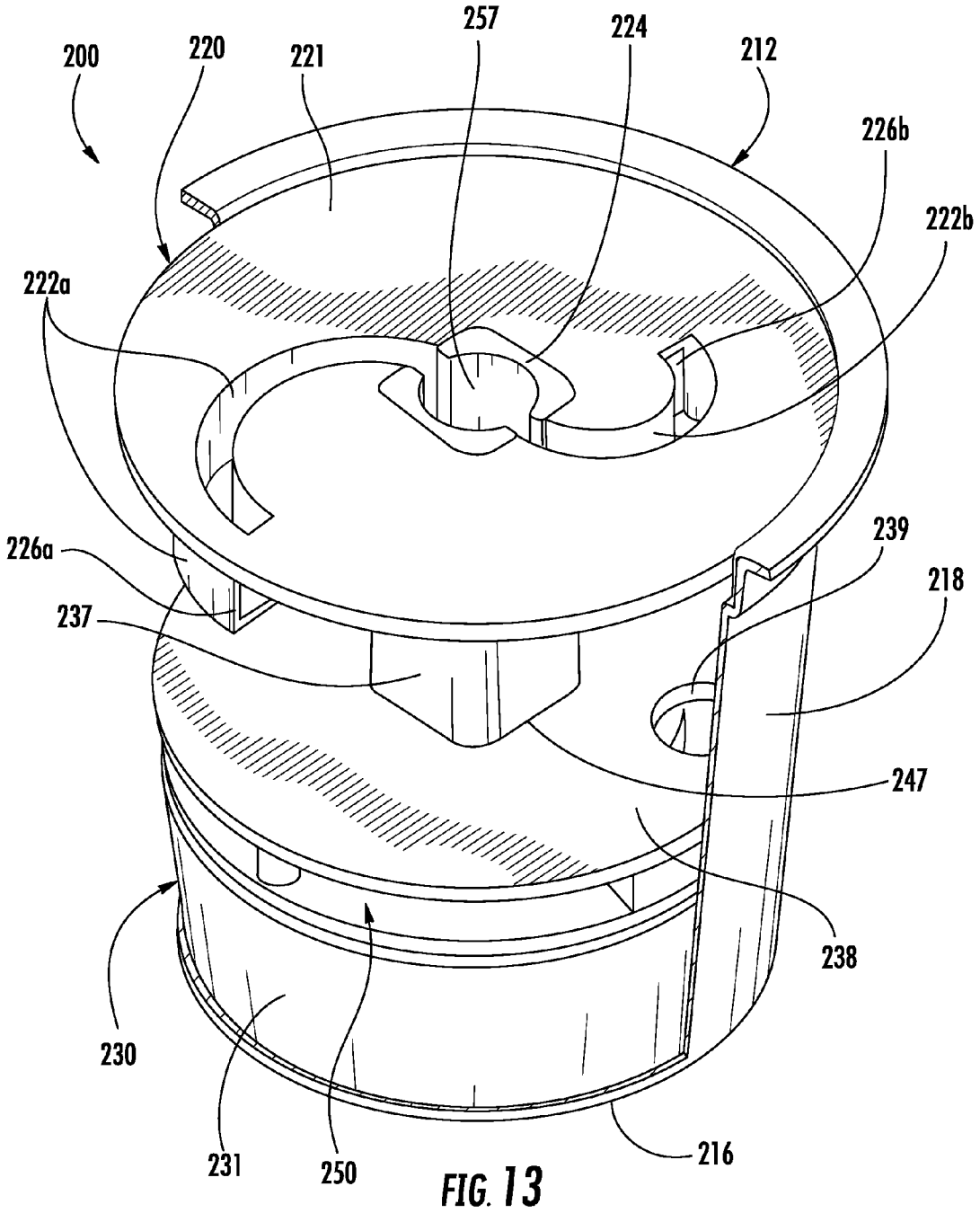
FIG. 13 is a partial cross sectional perspective view of a beverage mixing cartridge according to another preferred embodiment of the invention.
Figure 14:
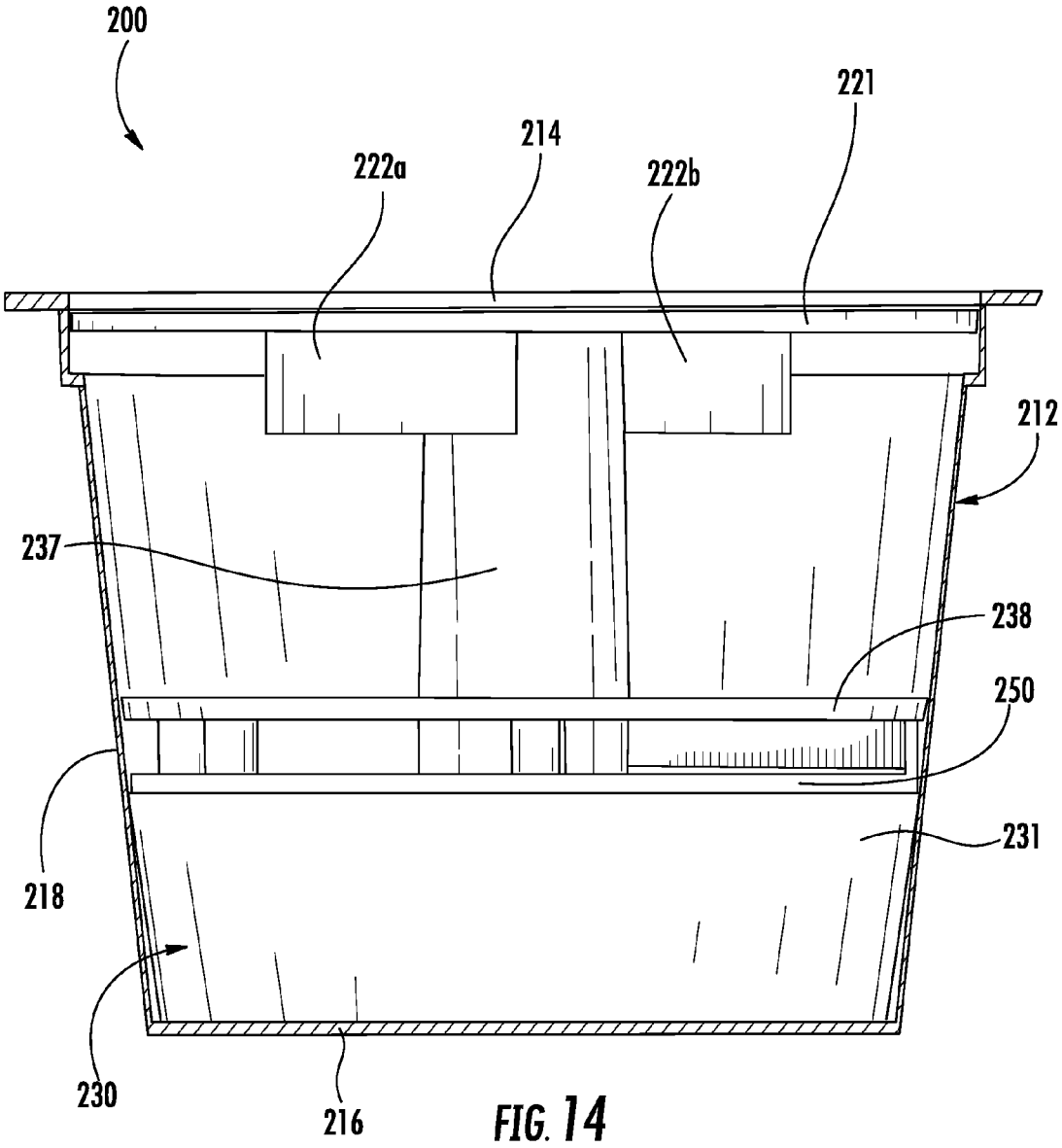
FIG. 14 is a cross sectional side view of the cartridge of FIG. 13.
Figure 15:
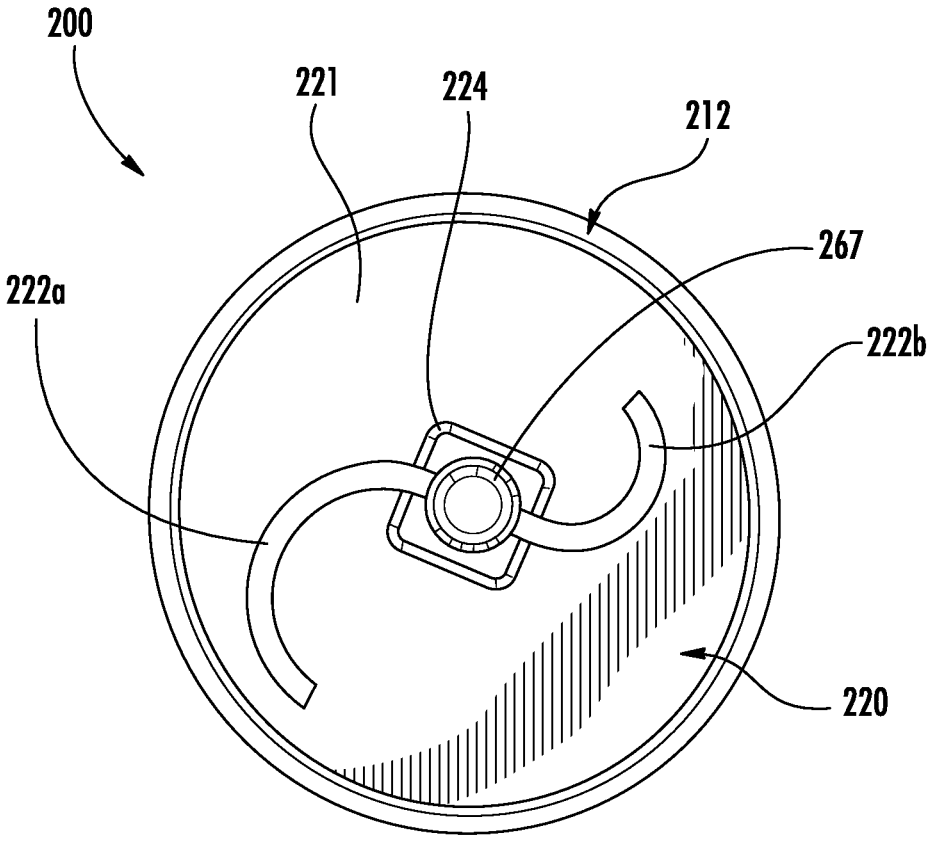
FIG. 15 is a top plan view of the cartridge of FIG. 13, with the top wall of the housing removed.
Figure 16:
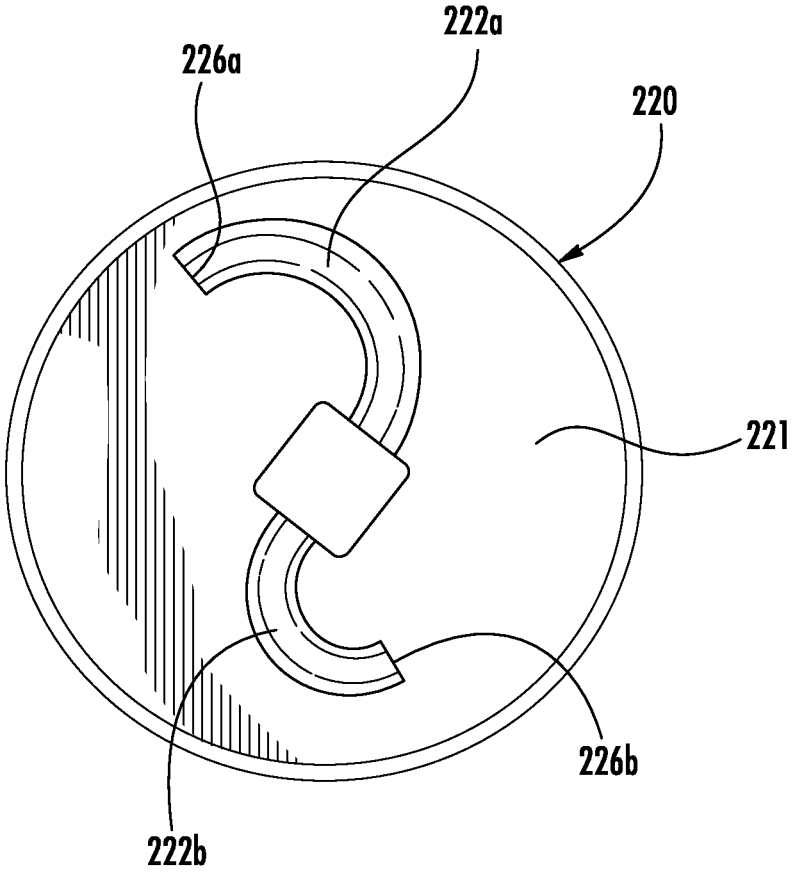
FIG. 16 is a bottom plan view of the upper channel section of the cartridge of FIG. 13.

An upper channel section 220 is positioned within the housing 212 proximate the top wall 212, as shown in FIGS. 13 and 14. The upper channel section 220 is comprised of a circular plate 221, and two arcuate channels 222*a*, 222*b* descending from the plate 221, and extending outwardly from a center opening 224, as shown in FIGS. 14-16. The ends of each arcuate channel 222*a*, 222*b* define upper exit openings 226*a*, 226*b*, respectively, as shown in FIG. 13. As such, each channel 222*a*, 222*b* arcs in different directions from the center opening 224 of the plate 221, forming a shape resembling a reverse "S", as shown in FIGS. 13, 15 and 16.

Figure 21:
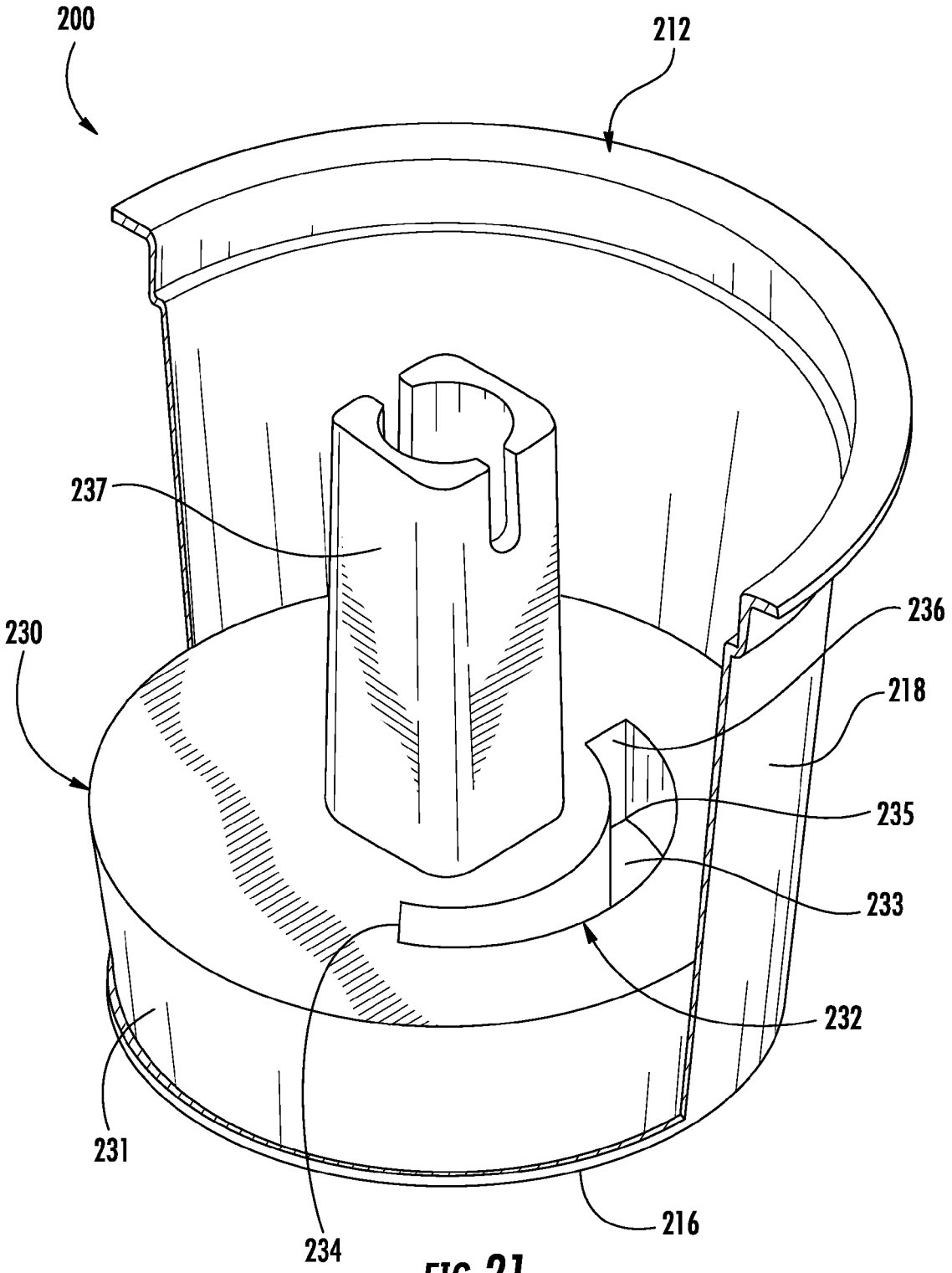
FIG. 21 is another partial cross sectional perspective view of the cartridge of FIG. 13.
Figure 22:
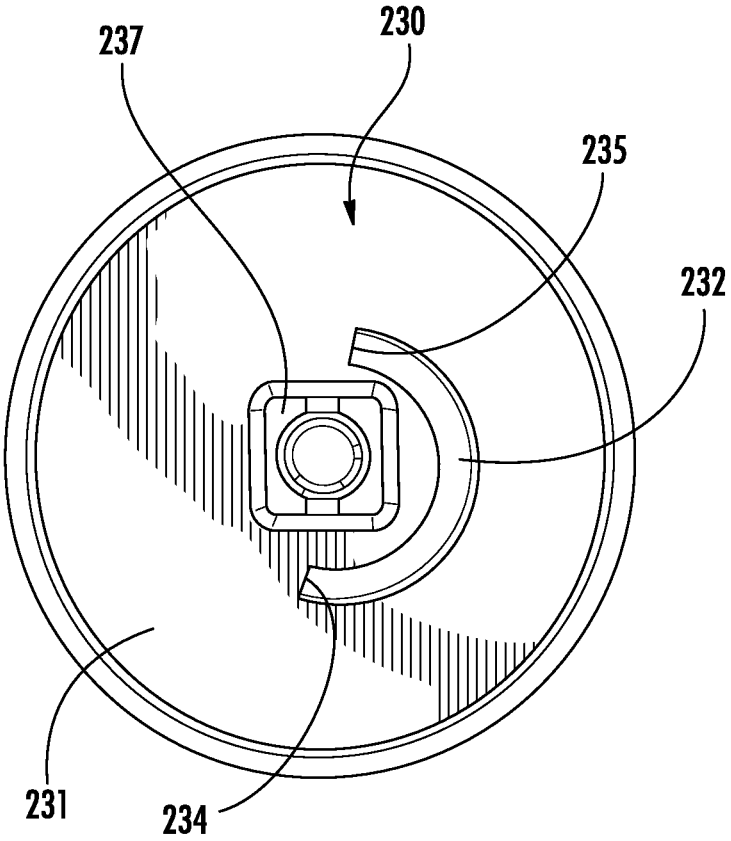
FIG. 22 is a top plan view of the lower channel section of the cartridge of FIG. 13.

A lower channel section 230 is positioned within the housing 212 below the upper channel section 20, as shown in FIGS. 13, 14 and 21. The lower channel section 230 is comprised of a substantially conical body 231, and an arcuate channel 232 descending from the upper surface of the body 231, as shown in FIGS. 21 and 22. The bottom of the body 231, shown in FIG. 22, rests on the base wall 214 of the housing 212, as shown in FIG. 21.

The lower arcuate channel 232 has a first end 234 and a second opposed end 235 that defines a lower exit opening 236, as shown in FIG. 21. The lower arcuate channel 232 includes a base 233 that declines from the first end 234 of the channel 232 to the second end 235 of the channel 232, as shown in FIG. 21. An elongate support stem 237 extends upwardly from the center of the body 231, as shown in FIG. 21. The support stem 237 provides structural support to the upper channel section 220. The support stem 237 can be a substantially rectangular column with rounded edges, as shown in FIG. 21. Alternatively, the support stem 237 can be substantially circular or other suitable shape. The center opening 224 of the upper channel section 220 is shaped and sized to receive and frictionally engage the support stem 237. An opening 267, shown in FIGS. 17 and 19, is formed in the top of support stem 237 that communicates with the upper arcuate channels 222*a*, 222*b*.

Figure 19:
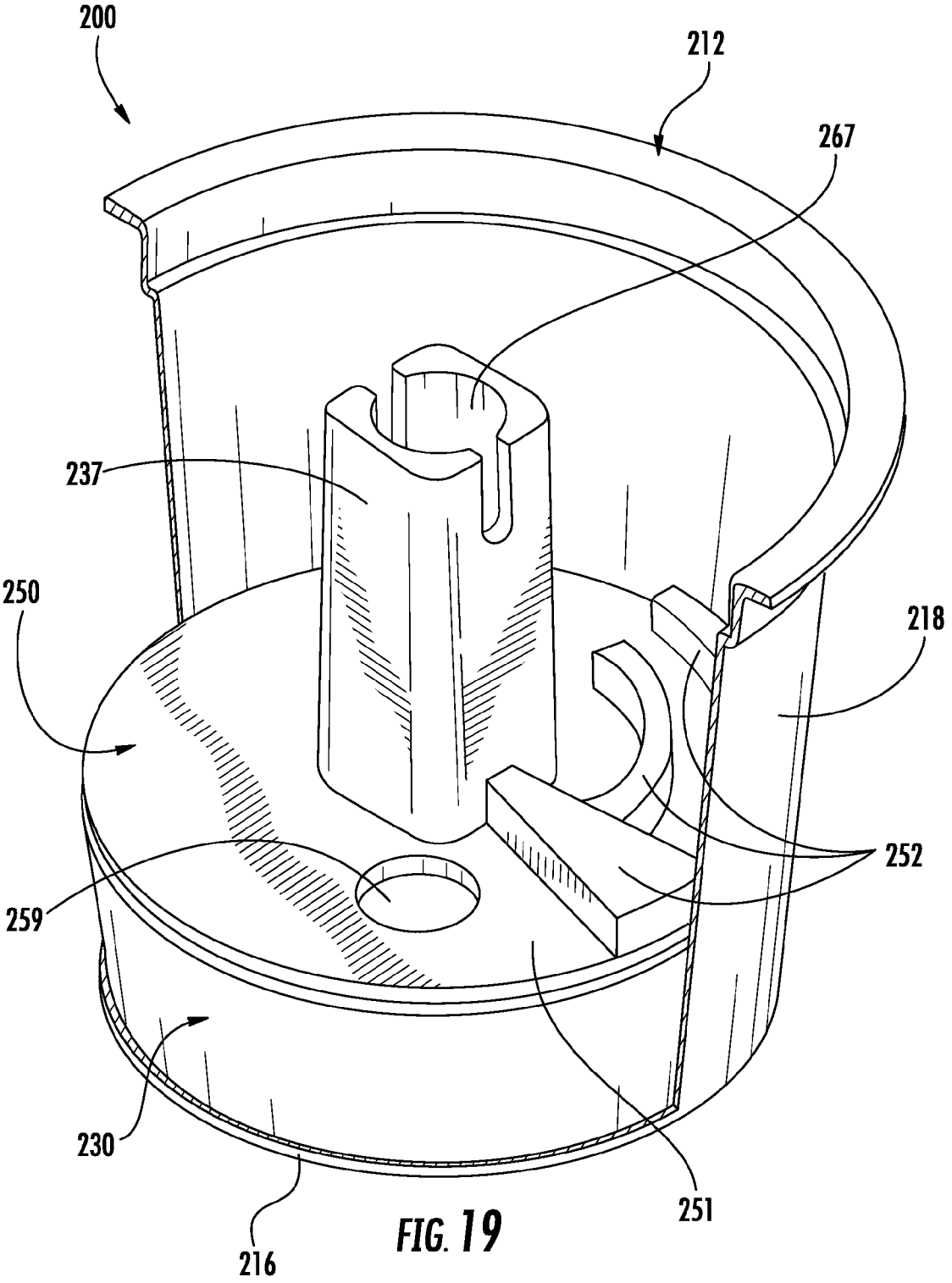
FIG. 19 is a partial cross sectional perspective view of the cartridge of FIG. 13.
Figure 20:
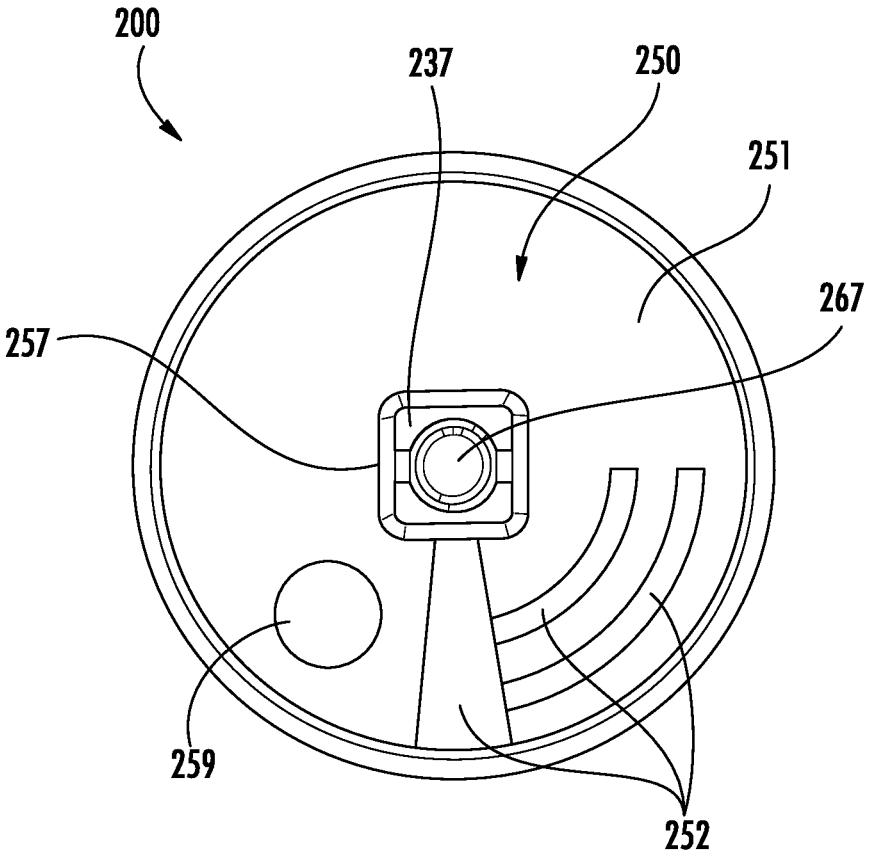
FIG. 20 is a top plan view of the intermediate channel section of the cartridge of FIG. 13.

The cartridge 100 includes an intermediate channel section 250 positioned above the lower channel section 230, as shown in FIGS. 19 and 20. The intermediate channel section 250 includes a center opening 257 that is shaped and sized to receive the support stem 237 there through. The intermediate channel section 250 comprises an arcuate channel 252 formed by three members 252 extending upwardly from a circular plate 251. A circular directional opening 259 is formed in the plate 251, such that it is directly above the lower arcuate channel 232. As such, the directional opening 259 directs liquid into the lower channel 232.

Figure 17:
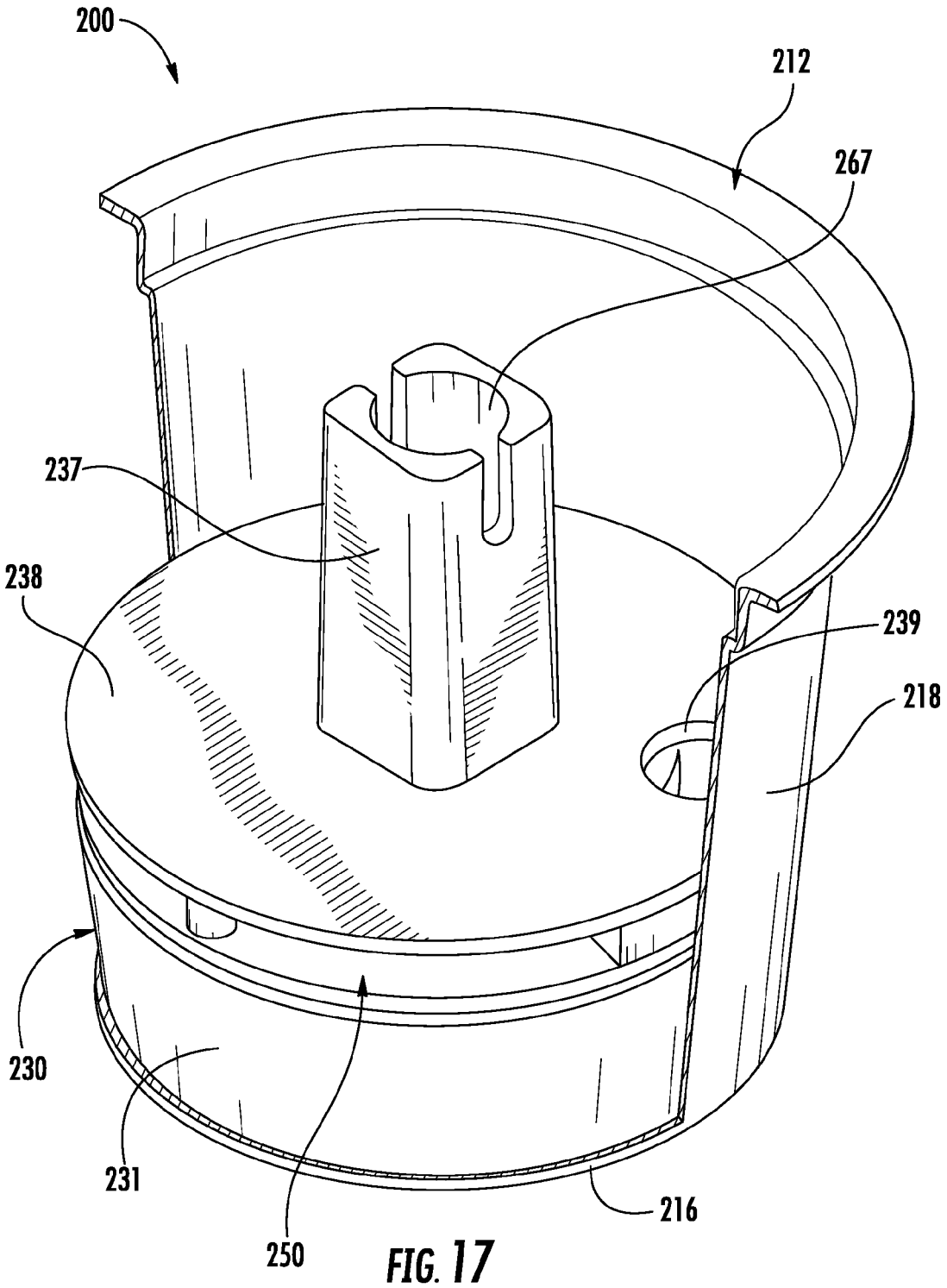
FIG. 17 is a partial cross sectional perspective view of the cartridge of FIG. 13, with the upper channel section removed.
Figure 18:
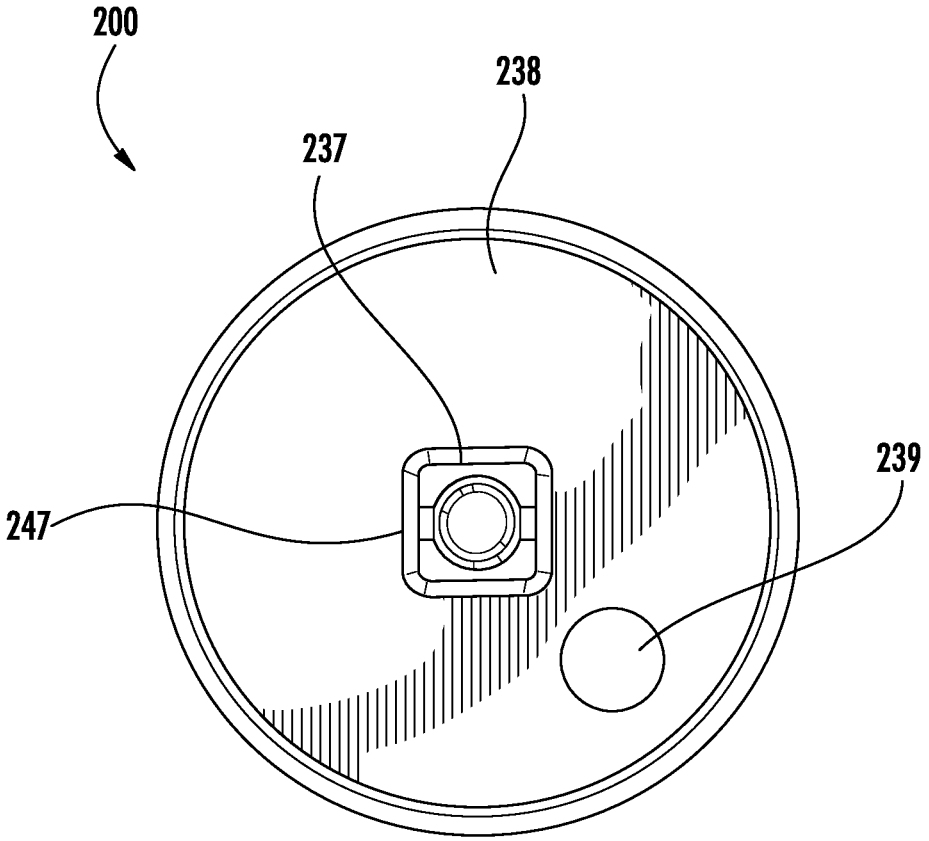
FIG. 18 is a top plan view of the cartridge of FIG. 13, with the upper channel section removed.

The cartridge 200 can include a flow distributor section comprising a cover plate 238 positioned over the intermediate channel section 250, as shown in FIGS. 17 and 18. The cover plate 238 has a substantially oval opening 239 that is positioned such that it is directly above the intermediate channel 252. As such, the opening 239 is in communication with the intermediate channel 252, and directs liquid into the intermediate channel 252. The cover plate 238 has a center opening 247 that is shaped, sized and positioned to receive the support stem 237 there through, as shown in FIGS. 19 and 20.

A beverage mixing cartridge and methods of making and using same are described above. Various changes can be made to the invention without departing from its scope. The above description of preferred embodiments and best mode of the invention are provided for the purpose of illustration only and not limitation—the invention being defined by the claims and equivalents thereof.

What is claimed is:

1. An apparatus for mixing a substance and a liquid, comprising:

(a) a housing;

(b) at least one swirl-inducing section positioned within the housing, and adapted for receiving the liquid and producing a substantially swirling movement of the liquid, wherein the at least one swirl-inducing section comprises a first channel section comprising a first substantially arcuate channel, the first substantially arcuate channel having first and second opposed ends, the first end defining a receptacle for receiving the liquid, and the second end defining a first channel opening for exiting the liquid, wherein movement of the liquid through the first arcuate channel produces a swirling movement of the liquid as the liquid exits the opening; and (c) a second channel section positioned within the housing below the first channel section, and comprising a second substantially arcuate channel having a first end for receiving the liquid and a second opposed end defining a second channel opening for exiting the liquid, wherein movement of the liquid through the second arcuate channel produces swirling movement of the liquid as the liquid exits the opening.

2. The apparatus according to claim 1, wherein the receptacle is formed proximate a center of the first channel section and is substantially circular.

3. The apparatus according to claim 2, further comprising a top cover plate positioned over the first channel section, the cover plate having an opening positioned above the receptacle to direct liquid into the receptacle.

4. The apparatus according to claim 3, wherein the first channel section comprises a substantially circular plate, the housing is substantially conical, and the top cover plate is substantially circular.

5. The apparatus according to claim 4, wherein the second end of the first substantially arcuate channel is proximate an outer edge of the first channel section.

6. The apparatus according to claim 1, wherein the second channel includes a base that declines from the first end of the second channel to the second end of the second channel.

7. The apparatus according to claim 1, further comprising a flow distributor section positioned over the second channel section, and having an opening positioned above the first end of the second channel to direct liquid into the second channel.

8. The apparatus according to claim 1, further comprising an elongate support member extending upwardly from a center of the second channel section and supporting the first channel section.

9. The apparatus according to claim 8, wherein the elongate support member is attached to a bottom surface of the first channel section.

10. The apparatus according to claim 8, further comprising a second channel section cover plate positioned on an upper surface of the second channel section, the second channel cover plate having a center opening for receiving the elongate support member therethrough and a directional opening positioned over the first end of the second channel to direct liquid into the second channel.

11. The apparatus according to claim 10, further comprising a first channel section cover plate positioned on an upper surface of the first channel section, the first channel section cover plate having a center opening positioned over the receptacle of the first channel, whereby liquid is directed into the receptacle.

12. A beverage mixing cartridge comprising:

(a) a housing comprising a top wall, a base wall and at least one side wall connected to the top wall and the base wall;

(b) a beverage medium contained within the housing; and (c) at least one swirl-inducing section positioned within the housing, the swirl-inducing section adapted for receiving a liquid and producing a substantially swirling movement of the liquid as the liquid exits the swirl-inducing section, wherein the at least one swirl-inducing section comprises:

(i) a first channel section positioned within the housing and comprising a first substantially arcuate channel, the first substantially arcuate channel having first and second opposed ends, the first end defining a receptacle for receiving a liquid, and the second end defining a first channel opening for exiting the liquid, wherein movement of the liquid through the first arcuate channel produces swirling movement of the liquid as the liquid exits the first channel opening; and (ii) a second channel section positioned within the housing below the first channel section and comprising a second substantially arcuate channel having a first end for receiving the liquid and a second opposed end defining a second channel opening for exiting the liquid, wherein movement of the liquid through the second arcuate channel causes further swirling movement of the liquid as the liquid exits the second channel opening, whereby the beverage medium is mixed with the liquid to produce a beverage.

13. The beverage mixing cartridge according to claim 12, further comprising:

(a) a first flow distributor plate positioned over the first channel section, the first flow distributor plate having a center opening positioned over the receptacle of the first channel, whereby liquid is directed into the receptacle of the first channel section;

(b) an elongate support member extending upwardly from a center of the second channel section and supporting the first channel section; and (c) a second flow distributor plate positioned below the first channel section and above the second channel section, the second flow distributor plate having a center opening for receiving the elongate support member therethrough and a directional opening positioned above the first end of the second channel, whereby liquid that has exited the first channel is directed into the second channel.

14. The beverage mixing cartridge according to claim 12, wherein the first channel section is attached to the top wall of the housing, and the top wall is pivotally attached to the at least one side wall.

15. The beverage mixing cartridge according to claim 12, wherein the beverage medium comprises solid instant infant formula particles.

16. A method of preparing a beverage comprising the steps of:

(a) providing a beverage mixing cartridge comprising:

(i) a housing;

(ii) a beverage medium contained within the housing; and (iii) a swirl-inducing section positioned within the housing, the swirl-inducing section adapted for receiving a liquid and producing a substantially swirling movement of the liquid as the liquid exits the swirl-inducing section, the swirl inducing section comprising a first channel section positioned within the housing and comprising a first substantially arcuate channel, the first substantially arcuate channel having first and second opposed ends, the first end defining a receptacle for receiving the liquid, and the second end defining a first channel opening for exiting the liquid, wherein movement of the liquid through the first arcuate channel produces swirling movement of the liquid as the liquid exits the first channel opening, and a second channel section positioned within the housing below the first channel section and comprising a second substantially arcuate channel having a first end for receiving the liquid and a second opposed end defining a second channel opening for exiting the liquid, wherein movement of the liquid through the second arcuate channel causes further swirling movement of the liquid as the liquid exits the second channel opening;

(b) introducing the liquid into the swirl-inducing section; and (c) allowing the liquid to move through the first substantially arcuate channel and the second substantially arcuate channel to produce a substantially swirling movement of the liquid, whereby the beverage medium is mixed with the liquid.

* * * * *